US011427889B2

(12) United States Patent
Kim et al.

(10) Patent No.: US 11,427,889 B2
(45) **Date of Patent: *Aug. 30, 2022**

(54) COPPER ALLOY FOR ENGINE VALVE SEATS MANUFACTURED BY LASER CLADDING

(71) Applicants: HYUNDAI MOTOR COMPANY, Seoul (KR); KIA MOTORS CORPORATION, Seoul (KR)

(72) Inventors: Young Nam Kim, Seongnam-si (KR); Min Woo Kang, Incheon (KR); Seung Hyun Hong, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 19 days.

This patent is subject to a terminal disclaimer.

(21) Appl. No.: 17/075,069

(22) Filed: Oct. 20, 2020

(65) Prior Publication Data

US 2021/0404034 A1 Dec. 30, 2021

(30) Foreign Application Priority Data

Jun. 24, 2020 (KR) ..... 10-2020-0077304

(51) Int. Cl.
*C22C 9/00* (2006.01)
*F01L 3/02* (2006.01)
*C22C 9/06* (2006.01)

(52) U.S. Cl.
CPC ..... *C22C 9/00* (2013.01); *C22C 9/06* (2013.01); *F01L 3/02* (2013.01); *F01L 2301/00* (2020.05)

(58) Field of Classification Search
None
See application file for complete search history.

(56) References Cited

U.S. PATENT DOCUMENTS

| | | | | |
|---|---|---|---|---|
| 5,004,581 | A | 4/1991 | Takagi et al. | |
| 5,911,949 | A * | 6/1999 | Ninomiya | C22C 9/06 420/487 |
| 6,037,067 | A | 3/2000 | Fujiki et al. | |
| 7,507,305 | B2 | 3/2009 | Kawasaki et al. | |
| 7,757,396 | B2 | 7/2010 | Sawada et al. | |
| 7,850,795 | B2 * | 12/2010 | Kawasaki | F01L 3/04 148/414 |
| 10,961,607 | B2 | 3/2021 | Oshima et al. | |
| 2007/0125458 | A1 | 6/2007 | Kawasaki et al. | |
| 2017/0037495 | A1 * | 2/2017 | Kawasaki | F01L 5/24 |
| 2018/0272471 | A1 | 9/2018 | Aoyama et al. | |
| 2018/0272472 | A1 | 9/2018 | Aoyama et al. | |
| 2019/0136346 | A1 | 5/2019 | Oshima et al. | |

(Continued)

FOREIGN PATENT DOCUMENTS

| | | | |
|---|---|---|---|
| EP | 0411882 | A1 | 2/1991 |
| EP | 1694876 | B1 | 1/2008 |

(Continued)

*Primary Examiner* — Elizabeth Collister
(74) *Attorney, Agent, or Firm* — Lempia Summerfield Katz LLC

(57) ABSTRACT

A copper alloy for engine valve seats manufactured by laser cladding improves wear resistance of the copper alloy. The copper alloy includes 12 to 24 wt % of Ni, 2 to 4 wt % of Si, 4 to 12 wt % of Mo, 15 to 35 wt % of Fe, and the remaining wt % of Cu and impurities.

5 Claims, 20 Drawing Sheets

(56) References Cited

U.S. PATENT DOCUMENTS

| | | | | |
|---|---|---|---|---|
| 2019/0276916 | A1* | 9/2019 | Kawasaki | B32B 15/017 |
| 2021/0115535 | A1* | 4/2021 | Kang | C22C 9/06 |

FOREIGN PATENT DOCUMENTS

| | | | |
|---|---|---|---|
| JP | H0647187 | B2 | 6/1994 |
| JP | 2748717 | B2 | 5/1998 |
| JP | H10339117 | A | 12/1998 |
| JP | 2018158379 | A | 10/2018 |
| JP | 2019085626 | A | 6/2019 |

* cited by examiner

FIG. 4

| Classification | Ni | Si | Mo | Fe | Cu | Crack generation | HAZ thickness (㎜) | Wear amount (㎛2) | Fe matrix area ratio (%) | Remarks |
|---|---|---|---|---|---|---|---|---|---|---|
| Comparative Example 1 | 17 | 3 | 6 | 9 | Bal. | No | 0.6 | 30,600 | - | |
| Example 1 | 17 | 3 | 8 | 15 | Bal. | No | 0.8 | 10,800 | 22 | |
| Example 2 | 17 | 3 | 8 | 25 | Bal. | No | 0.8 | 9,500 | 32 | |
| Example 3 | 17 | 3 | 8 | 35 | Bal. | No | 0.9 | 10,500 | 37 | |
| Example 4 | 17 | 3 | 4 | 15 | Bal. | No | 0.8 | 11,500 | 24 | |
| Example 5 | 17 | 3 | 4 | 25 | Bal. | No | 0.8 | 10,100 | 33 | |
| Example 6 | 17 | 3 | 4 | 35 | Bal. | No | 0.9 | 11,200 | 38 | |
| Example 7 | 17 | 3 | 12 | 15 | Bal. | No | 0.8 | 11,400 | 22 | |
| Example 8 | 17 | 3 | 12 | 25 | Bal. | No | 0.9 | 10,900 | 35 | |
| Example 9 | 17 | 3 | 12 | 35 | Bal. | No | 0.9 | 11,600 | 40 | |
| Comparative Example 2 | 17 | 3 | 4 | 10 | Bal. | No | 0.7 | 31,000 | 12 | |
| Comparative Example 3 | 17 | 3 | 8 | 10 | Bal. | No | 0.7 | 28,300 | 13 | |
| Comparative Example 4 | 17 | 3 | 12 | 10 | Bal. | No | 0.8 | 27,400 | 14 | |
| Comparative Example 5 | 17 | 3 | 4 | 40 | Bal. | Yes | 1.2 | 0 | 50 | |
| Comparative Example 6 | 17 | 3 | 8 | 40 | Bal. | Yes | 1.2 | 0 | 48 | |
| Comparative Example 7 | 17 | 3 | 12 | 40 | Bal. | Yes | 1.3 | 0 | 45 | |
| Comparative Example 8 | 17 | 3 | 15 | 15 | Bal. | No | 1 | 41,400 | 20 | Presence of sigma phase |
| Comparative Example 9 | 17 | 3 | 15 | 25 | Bal. | No | 1 | 42,500 | 25 | Presence of sigma phase |
| Comparative Example 10 | 17 | 3 | 15 | 35 | Bal. | No | 1 | 41,200 | 28 | Presence of sigma phase |
| Comparative Example 11 | 17 | 3 | 2 | 15 | Bal. | Generation of deep cracks | 0.7 | 46,500 | 18 | Acicular/ reticular Fe matrix |
| Comparative Example 12 | 17 | 3 | 2 | 25 | Bal. | Generation of deep cracks | 0.7 | 48,100 | 27 | Acicular/ reticular Fe matrix |
| Comparative Example 13 | 17 | 3 | 2 | 35 | Bal. | Generation of deep cracks | 0.7 | 47,400 | 33 | Acicular/ reticular Fe matrix |
| Comparative Example 14 | 17 | 3 | - | 25 | Bal. | Generation of deep cracks | 0.8 | 57,800 | 26 | Acicular/ reticular Fe matrix |

FIG. 7

| No | Fe(wt%) | Mo(wt%) | 1.04[Fe]-0.004[Mo] | Determination | Fe matrix area ratio(%) |
|---|---|---|---|---|---|
| 1 | 9 | 6 | 9.336 | fail | 0 |
| 2 | 15 | 8 | 15.568 | pass | 22 |
| 3 | 25 | 8 | 25.968 | pass | 32 |
| 4 | 35 | 8 | 36.368 | pass | 37 |
| 5 | 15 | 4 | 15.584 | pass | 24 |
| 6 | 25 | 4 | 25.984 | pass | 33 |
| 7 | 35 | 4 | 36.384 | pass | 38 |
| 8 | 15 | 12 | 15.552 | pass | 22 |
| 9 | 25 | 12 | 25.952 | pass | 35 |
| 10 | 35 | 12 | 36.352 | pass | 40 |
| 11 | 10 | 4 | 10.384 | fail | 12 |
| 12 | 10 | 8 | 10.368 | fail | 13 |
| 13 | 10 | 12 | 10.352 | fail | 14 |
| 14 | 40 | 4 | 41.584 | fail | 50 |
| 15 | 40 | 8 | 41.568 | fail | 48 |
| 16 | 40 | 12 | 41.552 | fail | 45 |
| 17 | 15 | 15 | 15.54 | fail | 19 |
| 18 | 15 | 2 | 15.592 | fail | 18 |

COPPER ALLOY FOR ENGINE VALVE SEATS MANUFACTURED BY LASER CLADDING

CROSS-REFERENCE TO RELATED APPLICATION

This application claims priority to Korean Patent Application No. 10-2020-0077304, filed on Jun. 24, 2020, in the Korean Intellectual Property Office, the disclosure of which is incorporated herein by reference in its entirety.

BACKGROUND

1. Field of the Disclosure

The present disclosure relates to a copper alloy for valve seats, and more particularly to a copper alloy for engine valve seats manufactured by laser cladding, wherein wear resistance of the copper alloy is improved.

2. Description of the Related Art

A cylinder head of an engine includes an engine valve, such as an intake valve and an exhaust valve. Combustion explosion heat and mechanical impact generated during operation of the engine are transmitted from the engine valve to the cylinder head. Since a general cylinder head is made of an aluminum (Al) material, however, the cylinder head is damaged by high temperature and impact.

Conventionally, therefore, at the time of manufacture of the cylinder head, a valve seat made of an Fe-based sintered powder is mounted to the region thereof which the engine valve contacts.

However, the valve seat made of the Fe-based sintered powder must be mounted to the cylinder head by mechanical coupling, and therefore a separate fastening means is required. As a result, the valve seat must be manufactured so as to have a predetermined thickness or more, whereby it is not possible to form a straight path. In addition, the valve seat may be separated from the cylinder head during operation of the engine.

Meanwhile, the valve seat endures conditions of contact and friction with the engine valve and conditions of exposure to exhaust gas. Therefore, the valve seat requires high heat resistance and wear resistance.

In recent years, therefore, at the time of manufacture of the cylinder head, a method of directly stacking (cladding) a clad layer on the region thereof which the engine valve contacts by laser cladding using a Cu-based material that exhibits high heat resistance and wear resistance is used in order to reinforce the region.

However, the wear resistance of the clad layer formed by laser cladding using the Cu-based material is much lower than the wear resistance of a valve seat manufactured using an Fe-based powder material.

In order to solve a problem with the Cu-based material, therefore, a method of forming a valve seat by laser cladding using an Fe-based material may be considered. In this case, however, higher heat input capacity than the Cu-based material, the melting point of which is about 1000° C. (e.g. 1000° C.±100° C.), is required, since the melting point of the Fe-based material is about 1400° C. or higher. As a result, greater thermal damage is applied to the cylinder head, which is made of aluminum (Al), whereby a heat affected zone is enlarged. Therefore, interface cracks and thermal cracks on the clad layer are generated. Consequently, it may be difficult to form a clad layer having the shape of a complete valve seat without leakage.

The matters disclosed in this section are merely for enhancement of understanding of the general background of the disclosure and should not be taken as an acknowledgment or any form of suggestion that the matters form the related art already known to a person skilled in the art.

SUMMARY

The present disclosure has been made in view of the above problems, and it is an object of the present disclosure to provide a copper alloy for valve seats having a dual-phase clad layer including both a Cu matrix structure and an Fe matrix structure formed by laser cladding, wherein the wear resistance of the clad layer is improved.

In accordance with the present disclosure, the above and other objects may be accomplished by the provision of a copper alloy for engine valve seats manufactured by laser cladding, wherein the copper alloy includes 12 to 24 wt % of Ni, 2 to 4 wt % of Si, 4 to 12 wt % of Mo, 15 to 35 wt % of Fe, and the remaining wt % of Cu and impurities.

The matrix structure of the copper alloy may have a dual phase including both a Cu matrix structure and an Fe matrix structure.

A NiSi-based hard phase may be formed in the matrix structure of the copper alloy, and at least one of a Mo-based Laves phase and a la (mu) hard phase may be further formed in the matrix structure of the copper alloy.

The area fraction of the Fe matrix structure of the copper alloy may be 20 to 40 wt % of the total area.

The copper alloy may satisfy Relation 1 below.

$$15.55<1.04[Fe]-0.004[Mo]<36.38 \quad \text{Relation 1}$$

where [Fe] and [Mo] mean the content (wt %) of Fe and Mo, respectively.

No sigma phase may be formed in the copper alloy.

The wear amount of the copper alloy measured through a high-temperature frictional wear experiment carried out under conditions below may be less than 20,000 $\mu m^2$.

(High-Temperature Frictional Wear Experimental Conditions)

Pin material: Inconel
Load: 50N
Temperature: 200° C.
Stroke: 7 mm
Number of vibrations: 6 Hz
Atmosphere: Air
Time: 10 min The thickness of a heat affected zone of the copper alloy may be 1 mm or less after laser cladding.

BRIEF DESCRIPTION OF THE DRAWINGS

The above and other objects, features and other advantages of the present disclosure will be more clearly understood from the following detailed description taken in conjunction with the accompanying drawings, in which:

FIG. 4 is a table showing components and experiment results of Comparative Examples and Examples;

FIG. 7 is a table showing the relationship between Relation 1 based on a change in the content of Fe and Mo and the area fraction of an Fe matrix structure.

DETAILED DESCRIPTION OF THE EMBODIMENTS

Figure 1:
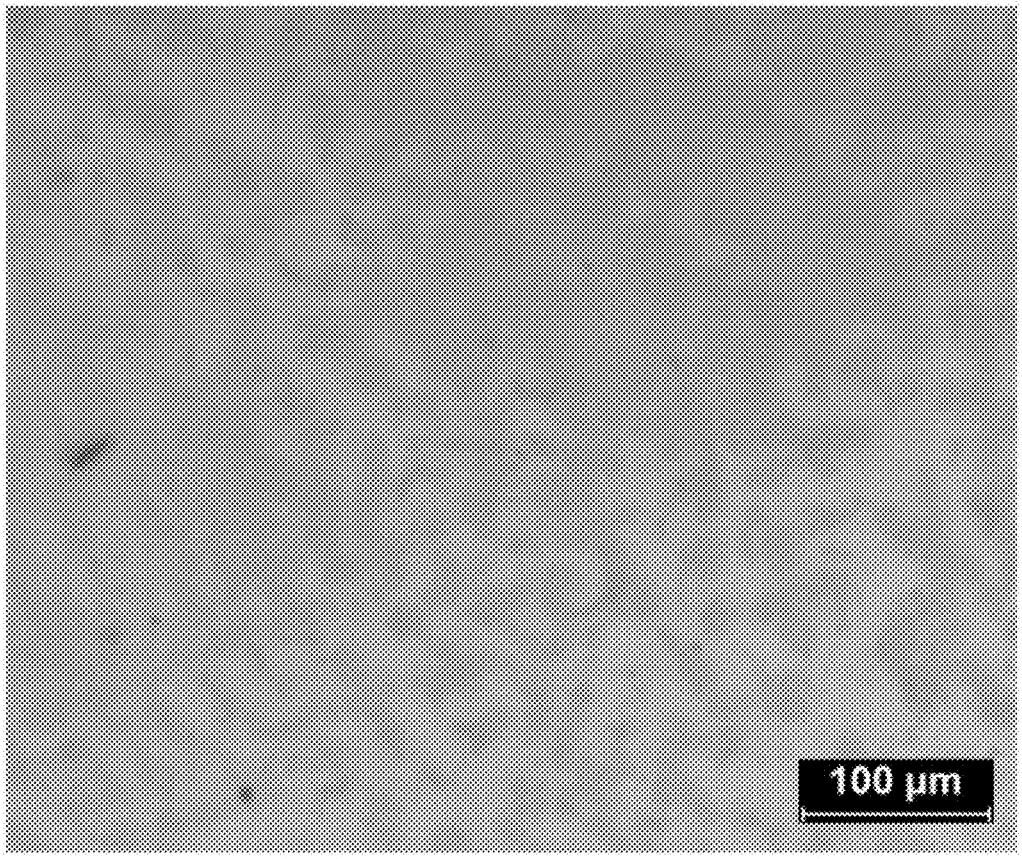
FIG. 1 is a microstructure photograph of a clad layer using a Cu-17Ni-3Si-25Fe material.
Figure 2A:
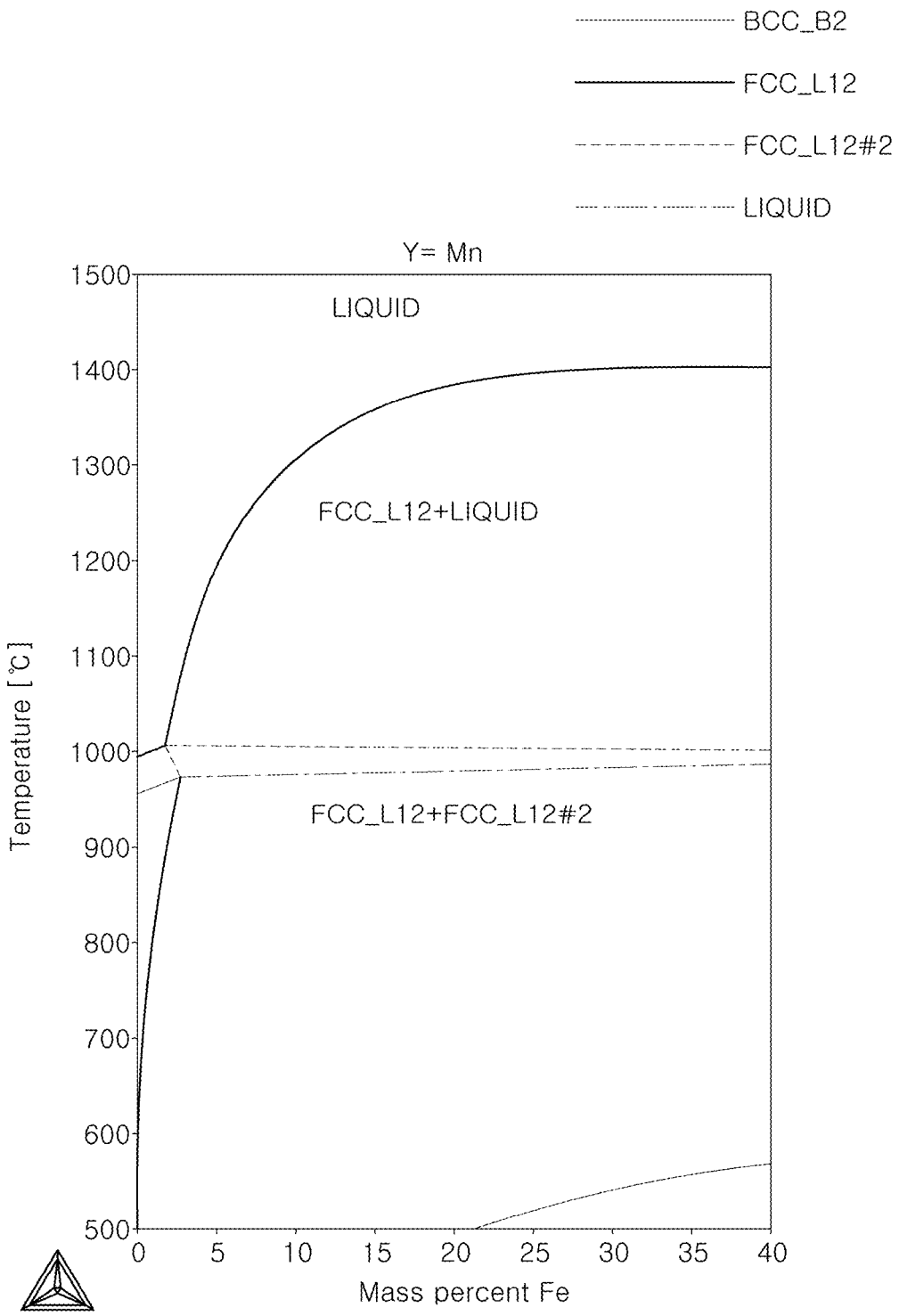
FIGS. 2A-2I are graphs showing the results of calculation of phase diagrams of alloy addition elements based on the content of Fe.
Figure 2B:
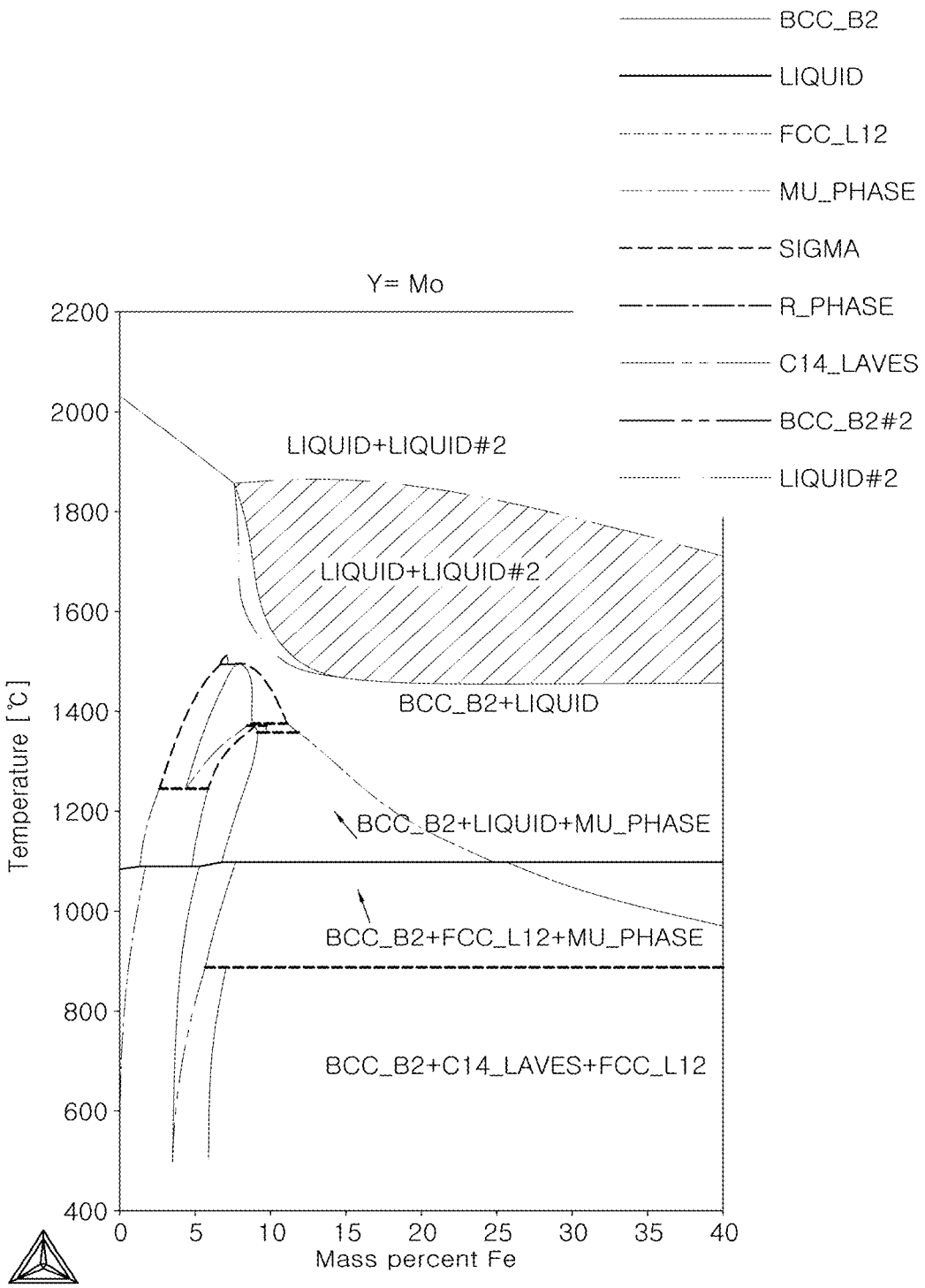
Figure 2C:
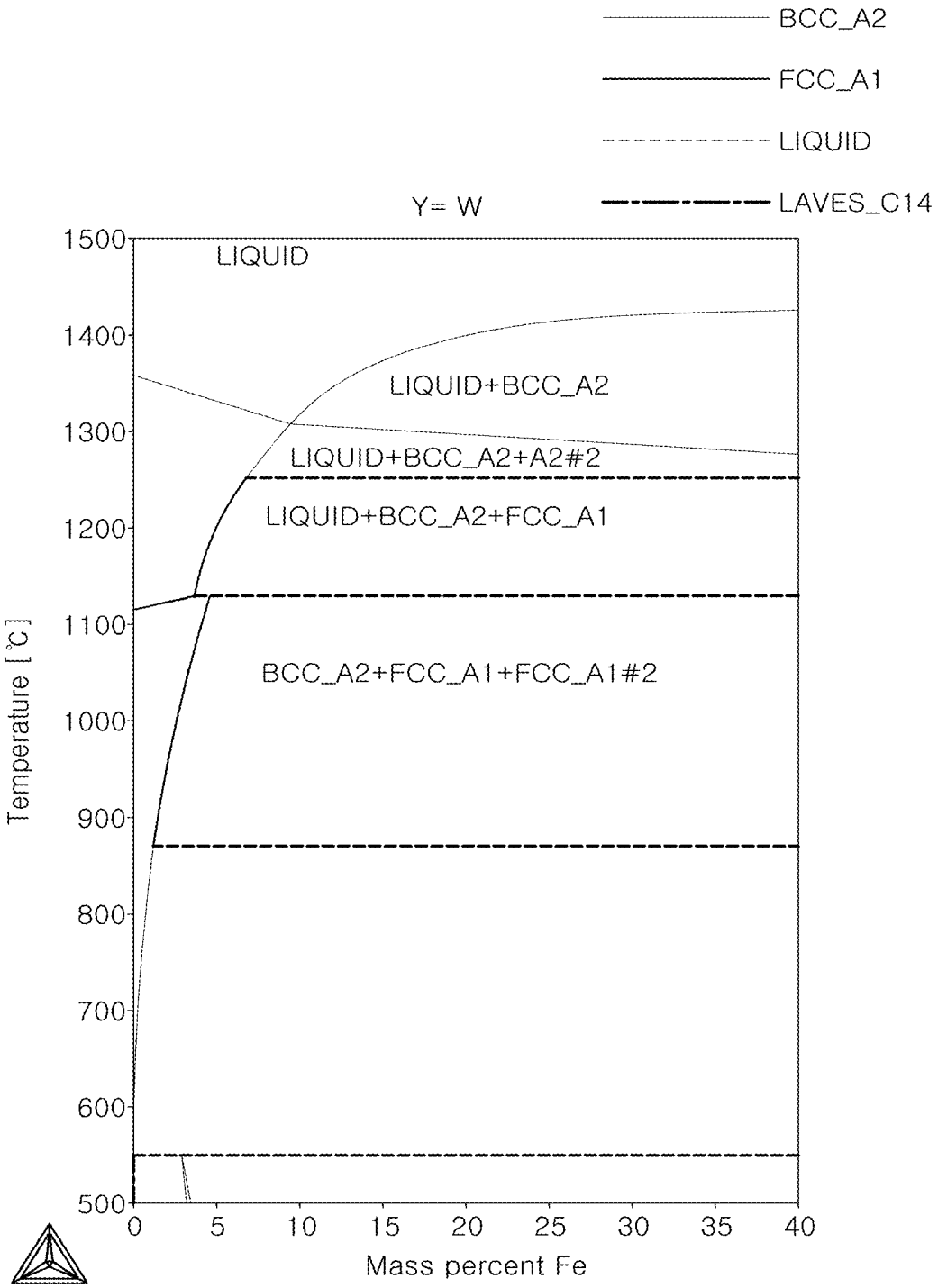
Figure 2D:
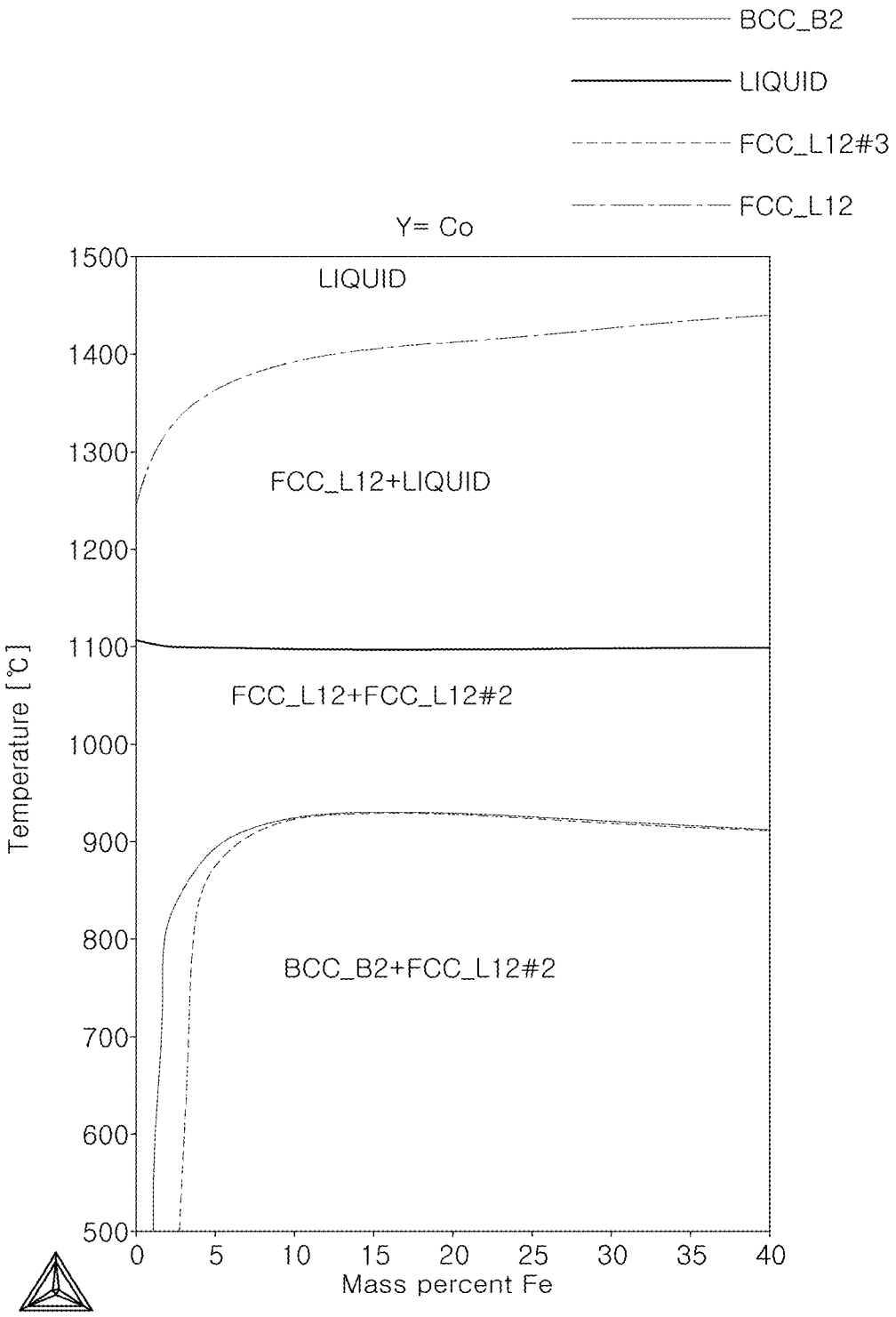
Figure 2E:
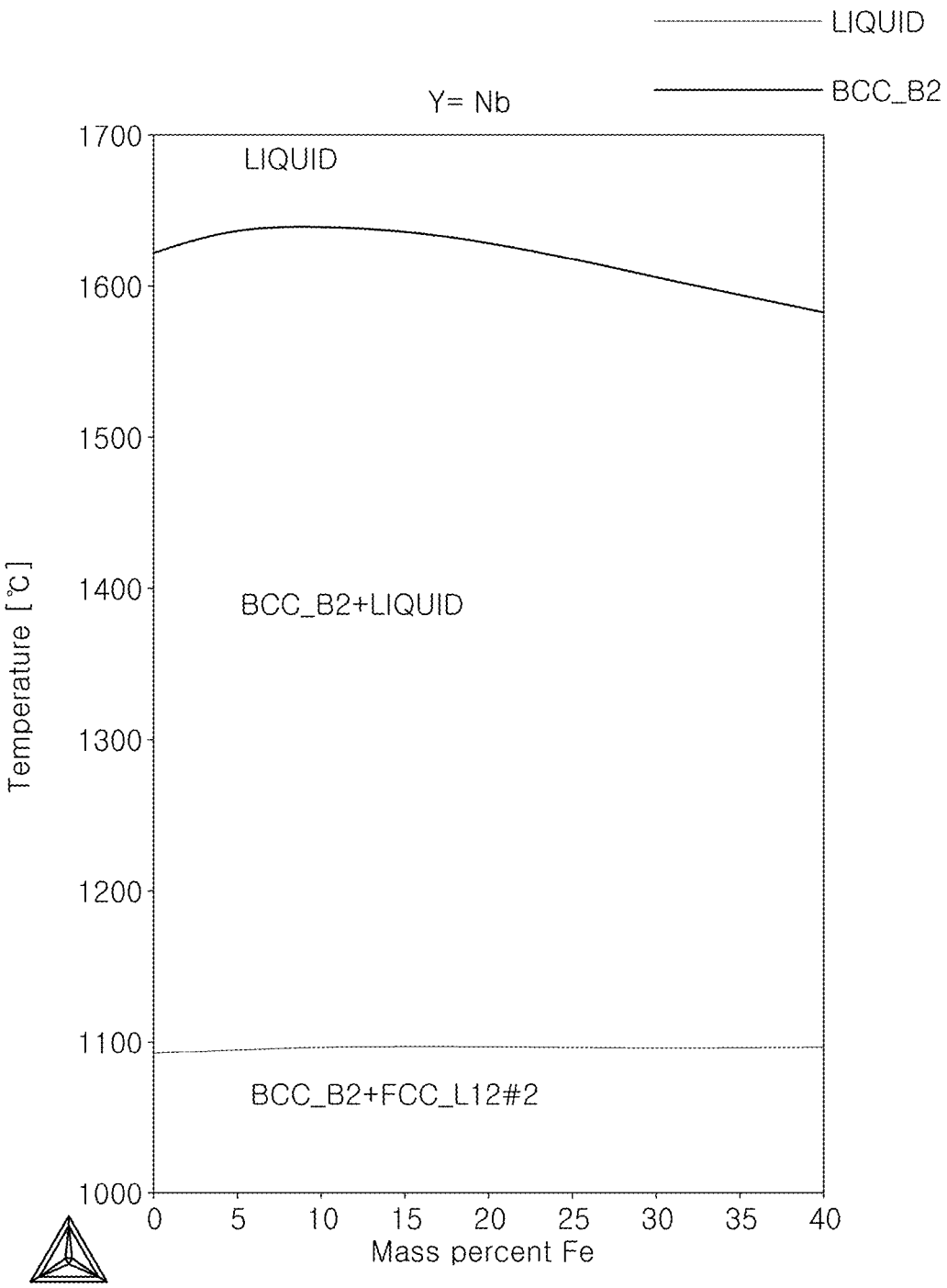
Figure 2F:
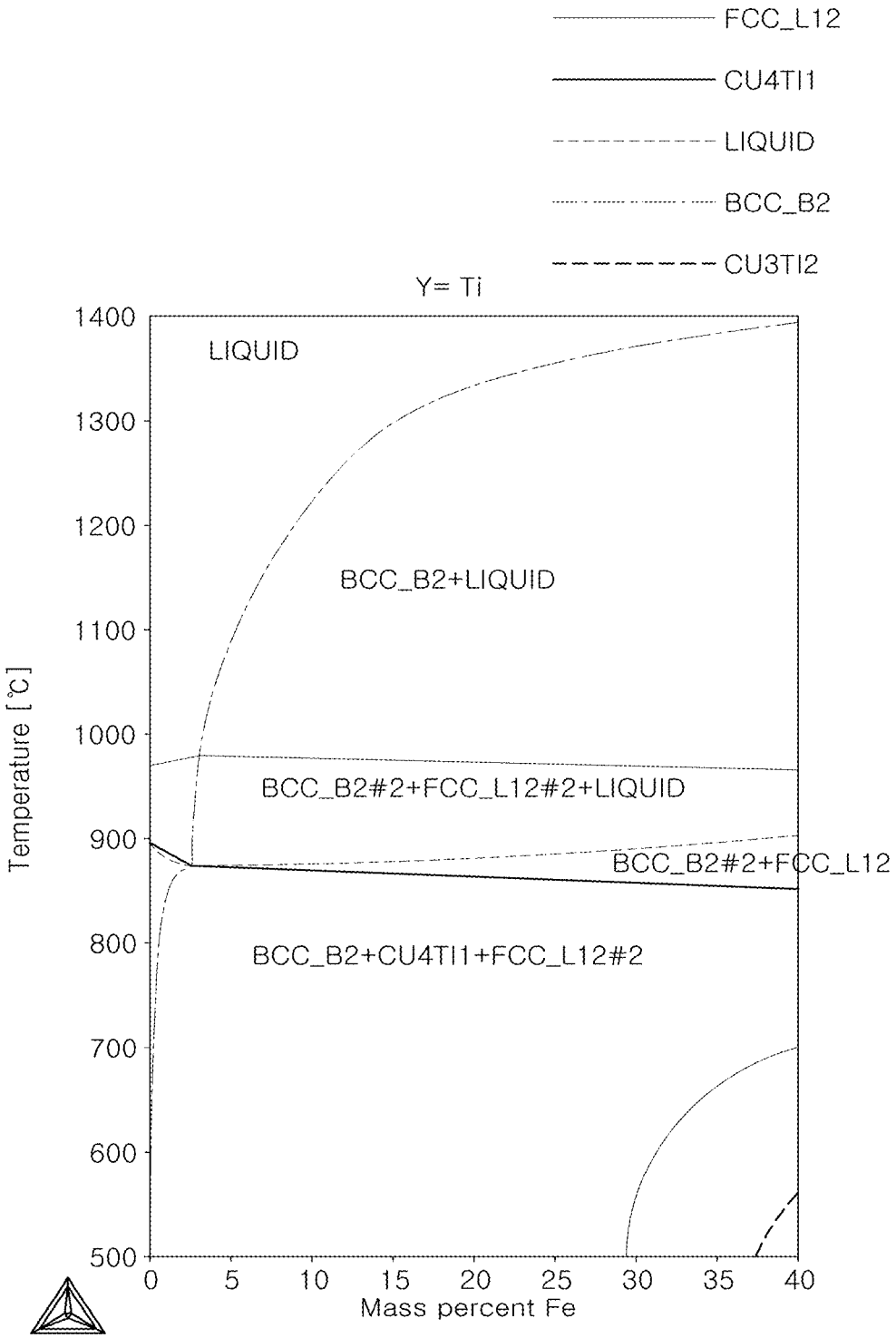
Figure 2G:
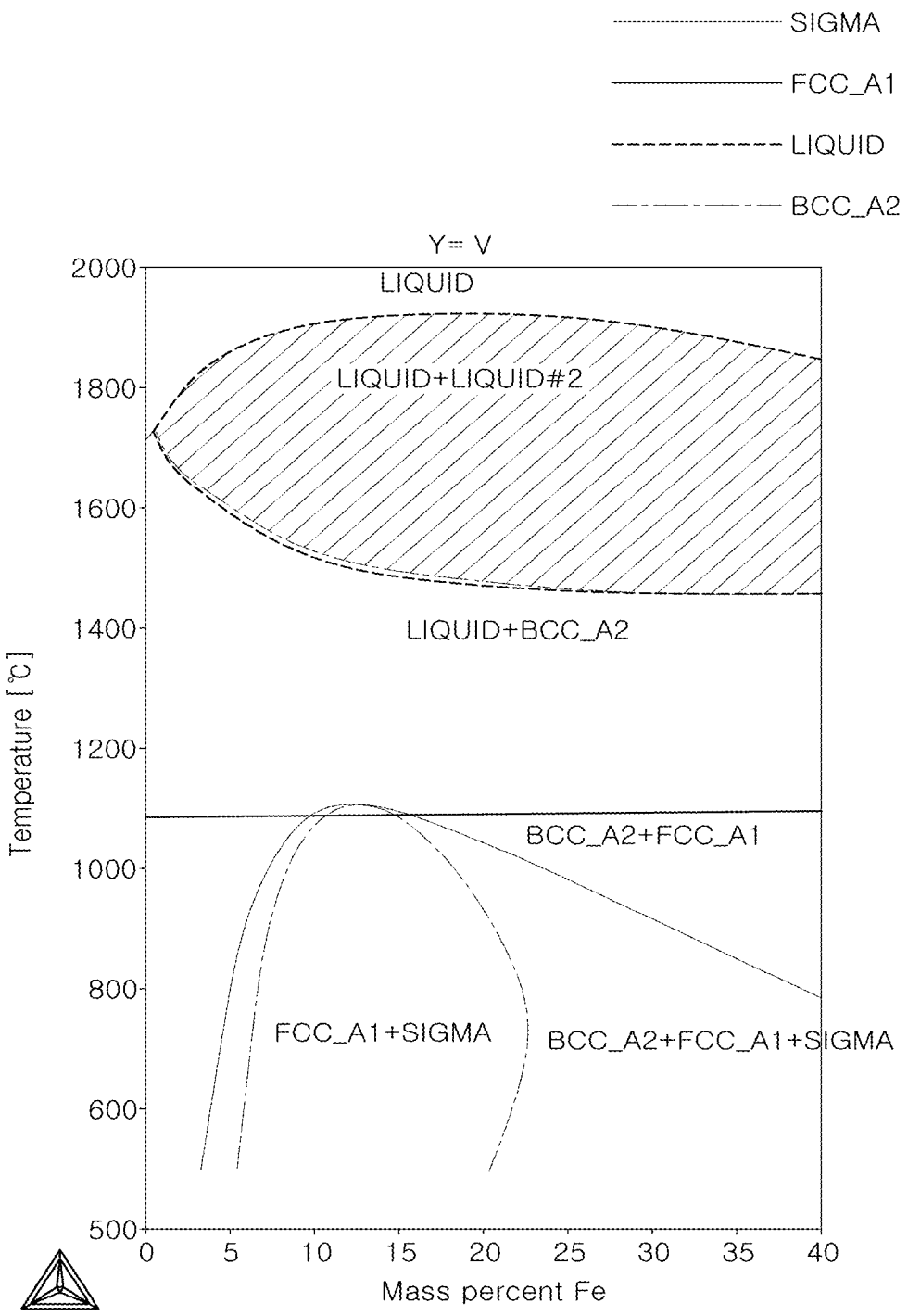
Figure 2H:
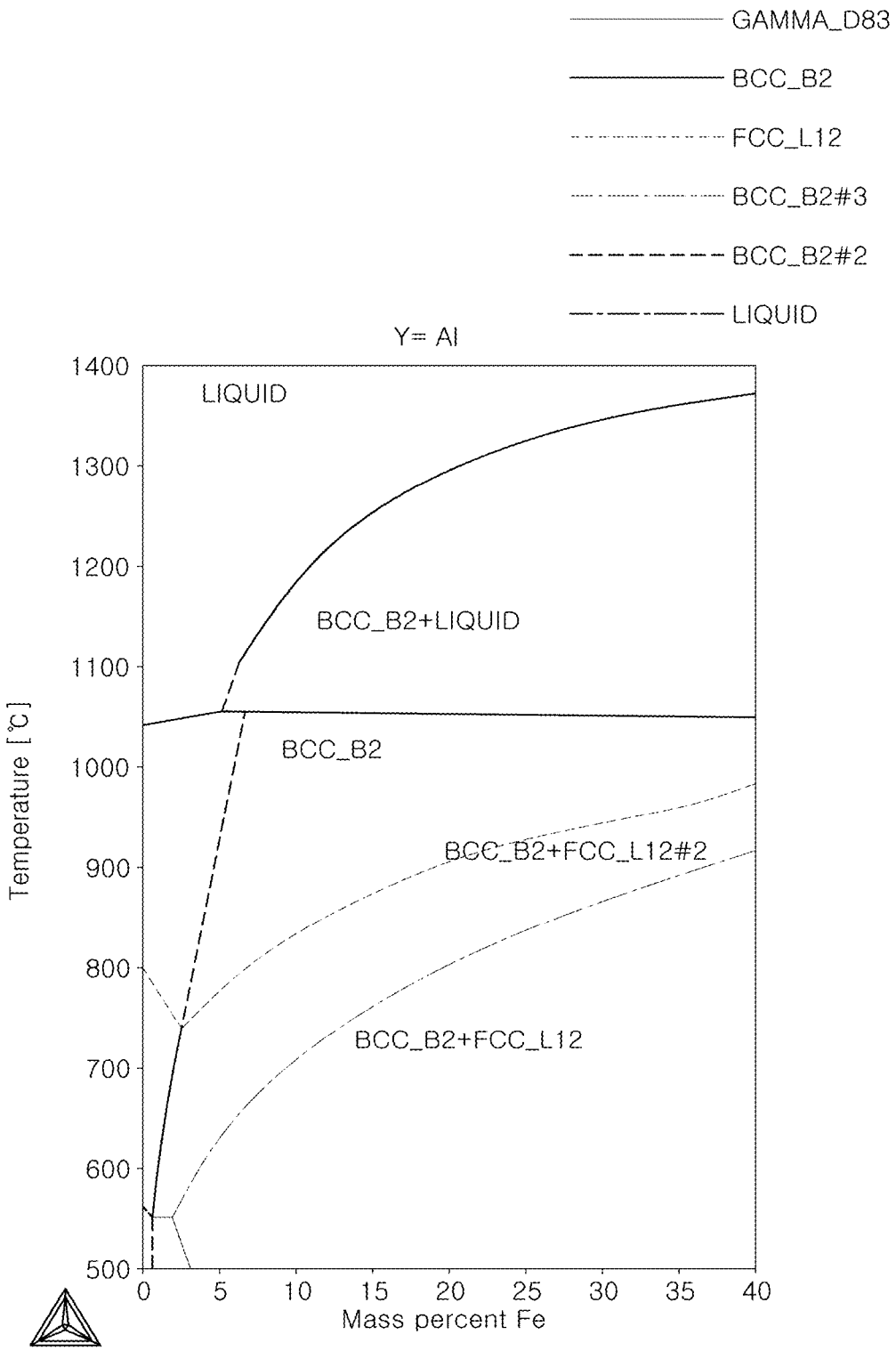
Figure 2I:
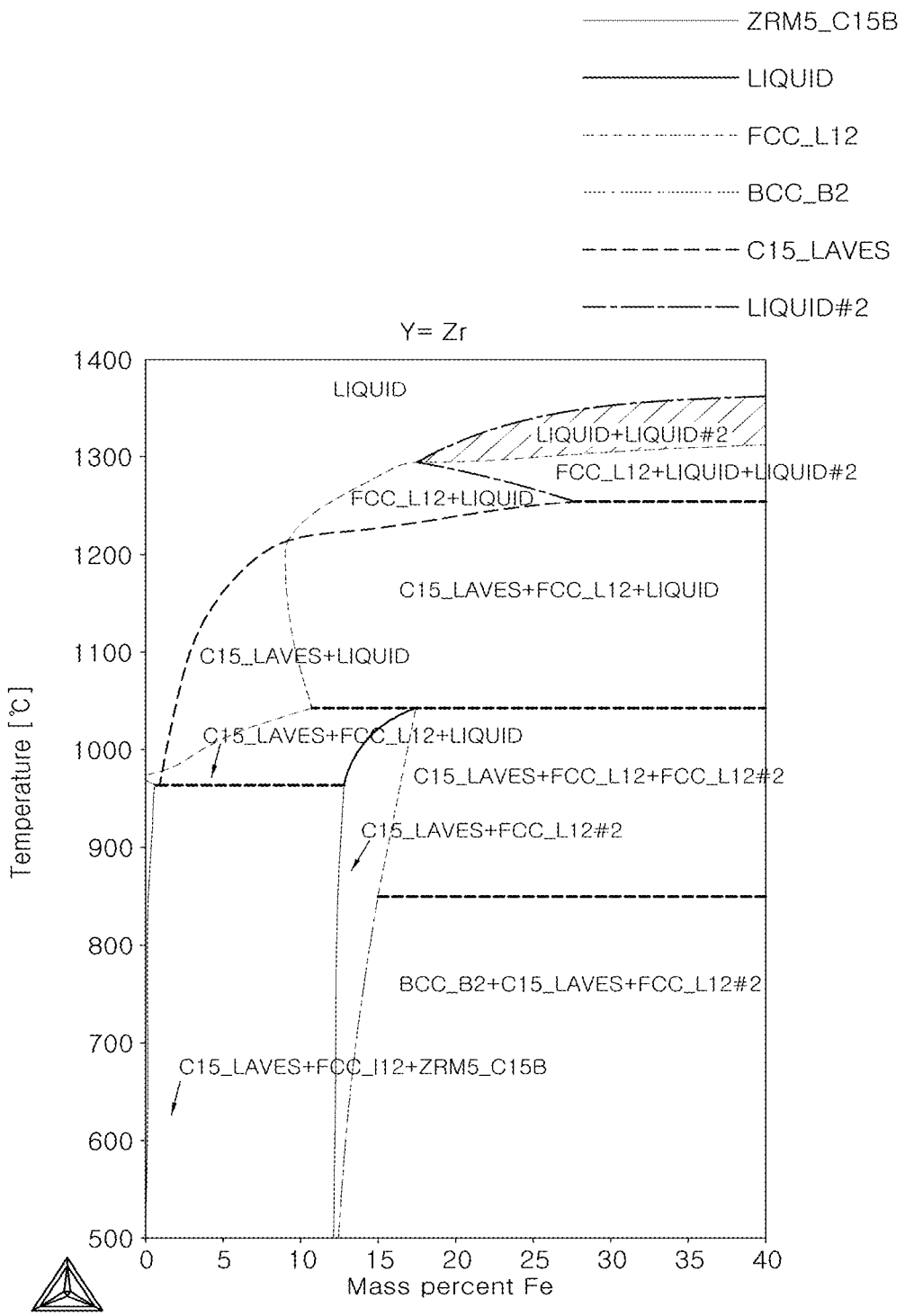

Hereinafter, embodiments of the present disclosure are described in detail with reference to the accompanying drawings. However, the present disclosure is not limited to the following embodiments but may be implemented in various different forms. The embodiments are provided merely to complete disclosure of the present disclosure and to fully provide a person having ordinary skill in the art to which the present disclosure pertains with the category of the disclosure.

A copper alloy for valve seats according to an embodiment of the present disclosure, which is an alloy that may be used in laser cladding, may have, for example, a clad layer formed at the region thereof which an engine valve of a cylinder head of an engine contacts using cladding, wherein the clad layer has improved heat resistance and wear resistance. The clad layer serves as a valve seat fastened to a conventional cylinder head. Hereinafter, a layer formed by laser cladding using the copper alloy for valve seats according to the embodiment of the present disclosure will be referred to as a "clad layer."

In the present embodiment, in order to improve heat resistance and wear resistance of a clad layer formed of a copper alloy, a dual-phase matrix structure including both a Cu matrix structure and an Fe matrix structure was formed.

The kind and composition of alloy elements were adjusted such that a NiSi-based hard phase, a Mo-based Laves phase, and a μ (mu) hard phase were formed in the matrix structure. In addition, the kind and composition of alloy elements were adjusted such that neither sigma phase nor P phase was formed while the area ratio of the Fe matrix structure was adjusted.

In particular, liquid immiscibility reaction was induced in order to adjust the kind and composition of alloy elements such that the Fe matrix structure has a roundish structure, rather than an acicular or reticular structure.

Specifically, the copper alloy for valve seats according to the embodiment of the present disclosure includes 12 to 24 wt % of Ni, 2 to 4 wt % of Si, 4 to 12 wt % of Mo, 15 to 35 wt % of Fe, and the remaining wt % of Cu and impurities.

In the present disclosure, the reason that the alloy elements and the composition range thereof are limited is as follows. Hereinafter, % stated in units of the composition range will mean wt %, unless particularly mentioned.

In some cases, 12 to 24% of nickel (Ni) is or may be contained. Nickel (Ni) forms a Cu—Ni—Si-based solidification structure, forms a strengthening phase, such as $Ni_2Si$ or $Ni_5Si_2$, and thus serves to improve the strength of a clad layer formed of an alloy. In order to maintain excellent strength and wear resistance of the clad layer, therefore, the content of nickel (Ni) is or may be, in some cases maintained at 12% or more. If the content of nickel (Ni) exceeds 24%, interface adhesion between a cylinder head, which is a base metal, and the clad layer is or may be deteriorated.

In some cases, 2 to 4% of silicon (Si) is or may be contained. Silicon (Si) forms a Cu—Ni—Si-based solidification structure and forms a silicide-based strengthening phase that may be expressed as $Ni_xSi_y$, such as $Ni_2Si$ or $Ni_5Si_2$, while improving the interface adhesion between the cylinder head, which is the base metal, and the clad layer. In order to form an appropriate strengthening phase while excellently maintaining the interface adhesion between the cylinder head and the clad layer, therefore, the content of silicon (Si) is or may be, in some cases, maintained at 2% or more. If the content of silicon (Si) exceeds 4%, softness of the clad layer decreases due to an increase in the fraction of the Cu—Ni—Si-based solidification structure, whereby cracks are generated.

In some cases, 4 to 12% of molybdenum (Mo) is or may be contained. Molybdenum (Mo), which is an element that induces liquid immiscibility, inhibits formation of an acicular or reticular structure. If the content of molybdenum (Mo) is less than 4%, therefore, liquid immiscibility does not occur at the time of solidification, whereby an acicular or reticular structure is or may be formed and thus crack resistance may be deteriorated. If the content of molybdenum (Mo) exceeds 12%, on the other hand, a sigma phase and a P phase are formed, whereby brittleness increases.

In some cases, 15 to 35% of iron (Fe) is or may be contained. Iron (Fe), which is an element that forms a hard Fe matrix structure, increases wear resistance. If the content of iron (Fe) is less than 15%, therefore, the fraction of the Fe matrix structure decreases, whereby wear resistance cannot be maintained at a desired level. If the content of iron (Fe) exceeds 35%, on the other hand, cracks are generated in the clad layer and the thickness of a heat affected zone exceeds 1 mm.

Meanwhile, the remainder other than the above components includes copper (Cu) and impurities.

Particularly, in the present embodiment, the content relationship between iron (Fe) and molybdenum (Mo) in the copper alloy is or may be defined such that the area fraction of the Fe matrix structure is 20 to 40% of the total area. Specifically, the content relationship between iron (Fe) and molybdenum (Mo) satisfies Relation 1 below.

$$15.55<1.04[Fe]-0.004[Mo]<36.38 \quad \text{Relation 1}$$

where [Fe] and [Mo] mean the content (wt %) of Fe and Mo, respectively.

Hereinafter, the present disclosure will be described based on Comparative Examples and Examples.

In the case in which a clad layer is formed by laser cladding using a Cu—Ni—Si-based material, which is an alloy material that is generally used in laser cladding, the wear resistance thereof is or may be much lower than the wear resistance of a valve seat manufactured using a conventional Fe-based powder material.

In order to improve wear resistance of the Cu—Ni—Si-based material, therefore, an experiment of adding Fe to the Cu—Ni—Si-based material in order to form both a Cu matrix structure and an Fe matrix structure was carried out.

In other words, a clad layer was formed on an aluminum (Al) base metal by laser cladding using a Cu-17Ni-3Si-25Fe material, and the microstructure of the clad layer was observed. The result is shown in FIG. 1. Here, the 17Ni-3Si-25Fe material means a copper alloy including 17 wt % of Ni, 3 wt % of Si, 25 wt % of Fe, and remaining wt % of Cu and impurities.

It may be seen from FIG. 1 that, in the case in which Fe alone was added to a component system of Cu-17Ni-3Si, a dual phase including both a Cu matrix structure and an Fe matrix structure was formed as a matrix structure. The Fe matrix structure was formed as an acicular and reticular structure. In FIG. 1, the structure indicated by a relatively dark color is the Fe matrix structure and the structure indicated by a relatively light color is the Cu matrix structure.

The reason that the Fe matrix structure is formed as an acicular and reticular structure is that no liquid immiscibility reaction occurs, whereby the Fe matrix structure is not randomly dispersed although the Fe matrix structure is formed.

It is known that, in the case in which the Fe matrix structure is formed as an acicular and reticular structure, as shown in FIG. 1, the interface between structures increases and the interface provides a fracture path, whereby wear resistance of the clad layer is or may be greatly deteriorated.

Subsequently, in order to induce liquid immiscibility reaction, an experiment of forming both a Cu matrix structure and a Fe matrix structure using a Cu-17Ni-3Si-aFe-20Y material was carried out. Here, a is the content (wt %) of Fe, and Y is an alloy element that is added together with Fe. In this experiment, an alloy element selected from among the group consisting of Mn, Mo, W, Co, Nb, Ti, V, Al, and Zr was selectively added as Y. The results of calculation of phase diagrams of the respective materials based on the content of Fe are shown in FIGS. 2A-2I. In FIGS. 2A-2I, regions indicated by dark colors are liquid immiscibility occurrence regions.

It may be seen from FIGS. 2A-2I that liquid immiscibility occurred in the case in which Mo, V, and Zr were added and no liquid immiscibility occurred in the case in which Mn, W, Co, Nb, Ti, and Al were added. This may result because solid solubility of liquid-phase Fe with respect to Cu decreases due to addition of Mo, V, and Zr. Thus, liquid immiscibility of a Cu-based component and an Fe-based component is or may be induced.

Therefore, it may be seen that, in the case in which Mo, V, and Zr were added, a dual phase including both a Cu matrix structure and an Fe matrix structure was formed while the Fe matrix structure was formed as a roundish structure, rather than an acicular or reticular structure.

Among the added components, however, V is a relatively expensive alloy element and Zr has a small liquid immiscibility area, whereby no structural change is induced. Therefore, it may be seen that adding Fe and Mo to the Cu—Ni—Si-based material may induce liquid immiscibility of the Cu-based component and the Fe-based component.

Subsequently, in order to derive appropriate content of Mo, an experiment of observing a change in phase of an alloy using a Cu-17Ni-3Si-25Fe-bMo material was carried out. Here, b is the content (wt %) of Mo. The results of calculation of phase diagrams based on the content of Mo are shown in FIG. 3.

Figure 3:
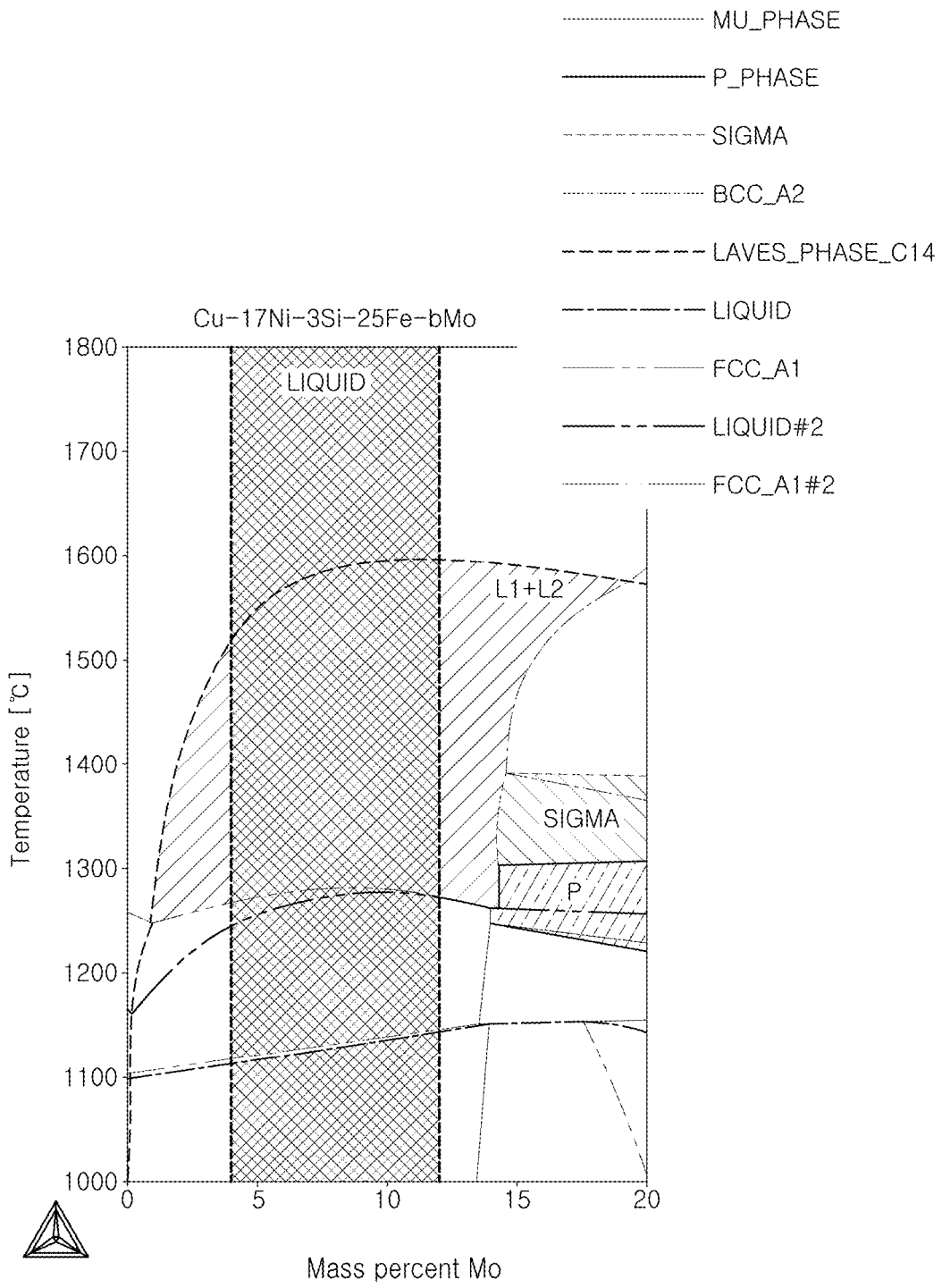
FIG. 3 is a graph showing the results of calculation of phase diagrams based on the content of Mo.

As may be seen from FIG. 3, the temperature region in which liquid immiscibility occurs is or may be narrow in the region in which the content of Mo is less than 2 wt %, and in some cases 4 wt %. Therefore, it is or may be difficult to avoid formation of an acicular and reticular structure. In addition, a sigma phase and a P phase are formed in the region in which the content of Mo exceeds 13.5 wt %, and in some cases 12 wt %. Therefore, impact toughness decreases. In some cases, therefore, the content of Mo is or may be 4 to 12 wt %.

Figure 5A:
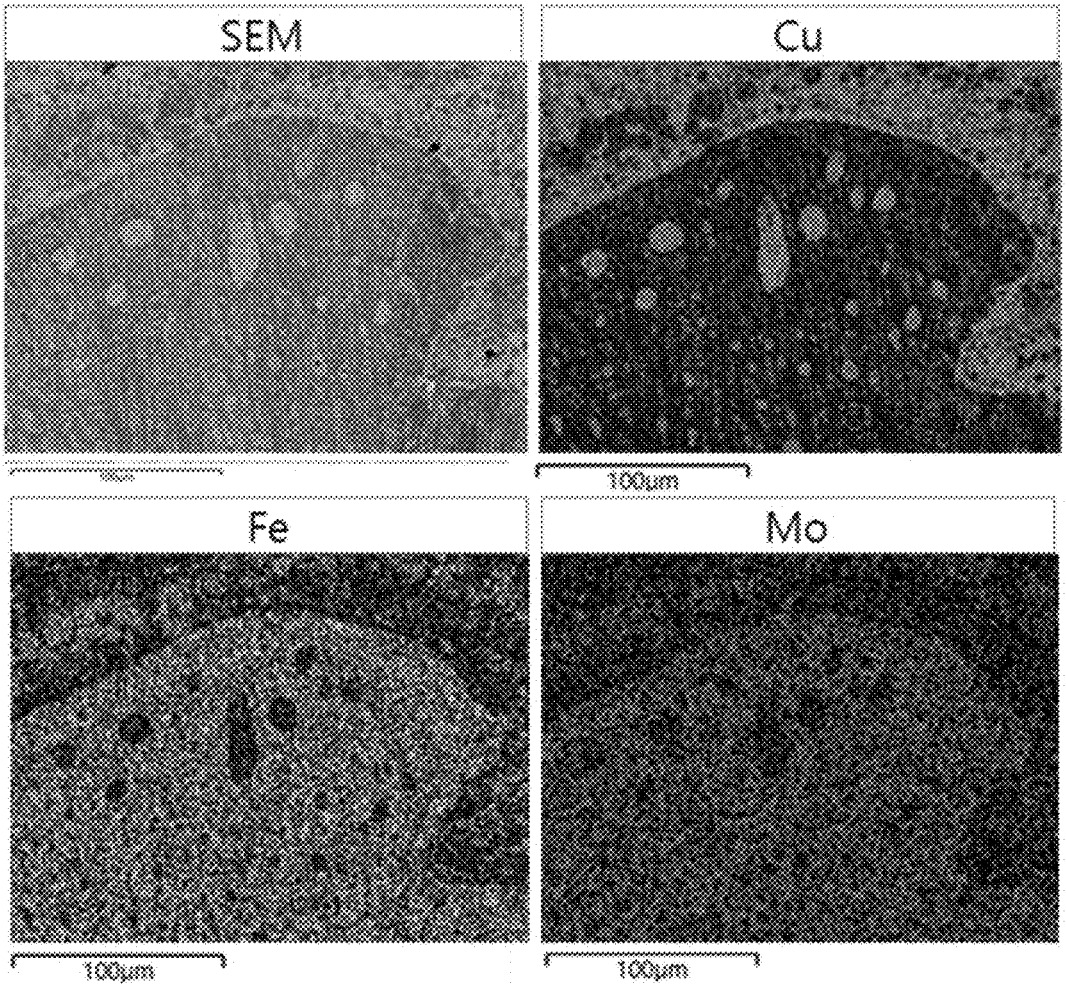
FIGS. 5A and 5B are microstructure photographs of Example 2 and Comparative Example 14, respectively.
Figure 5B:
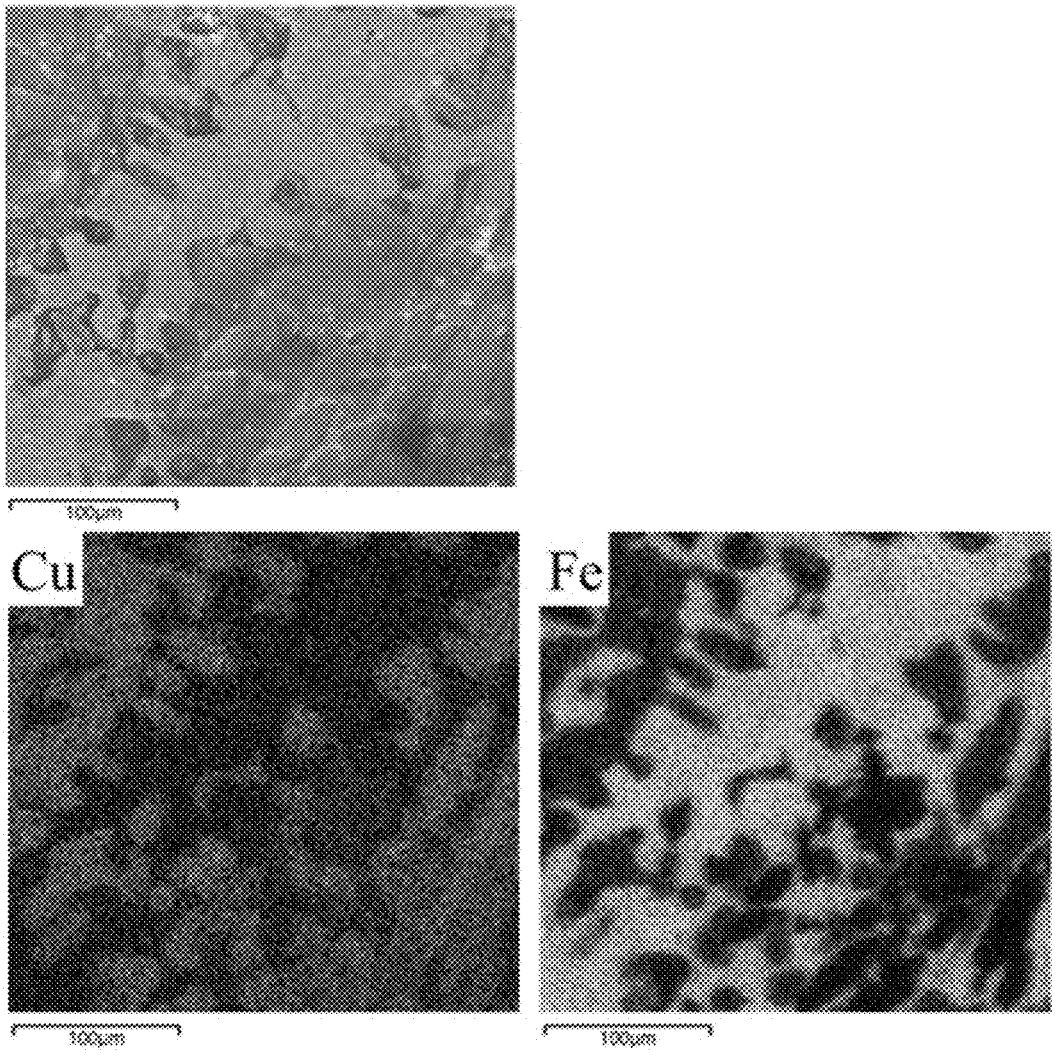

Subsequently, in order to derive appropriate content of Fe and Mo in the Cu—Ni—Si-based material, a clad layer was formed on an aluminum (Al) base metal by laser cladding using a copper alloy including components having adjusted content, as shown in FIG. 4. Cracks in the clad layer, the thickness of a heat affected zone of the clad layer, the wear amount of the clad layer, and the microstructure of the clad layer were measured and observed. The results are also shown in FIG. 4. In addition, the microstructures of Example 2 and Comparative Example 14 of FIG. 4 are shown in FIGS. 5A and 5B, respectively. Furthermore, the microstructures of Examples 4 to 6 and Comparative Examples 2 and 5 of FIG. 4 are sequentially shown in FIGS. 6A to 6E, respectively.

At this time, the wear amount was measured through a high-temperature frictional wear experiment under the following experimental conditions.

(High-Temperature Frictional Wear Experimental Conditions)

Pin material: Inconel
Load: 50N
Temperature: 200° C.
Stroke: 7 mm
Number of vibrations: 6 Hz
Atmosphere: Air
Time: 10 min As may be seen from FIGS. 4, 5A, 5B, and 6A-6E, in the case of Comparative Example 1, in which Fe and Mo were added to a component system of Cu-17Ni-3Si but the added amount of Fe was less than the content suggested by the present disclosure, no cracks were generated and the thickness of the heat affected zone was 0.6 mm, which is relatively small. However, no Fe matrix structure was formed, and the wear amount was considerably large.

In the case of Examples 1 to 9, which satisfied the alloy components and the content thereof suggested by the present disclosure, no cracks were generated, and the thickness of the heat affected zone (1 mm or less), the wear amount (20,000 $\mu m^2$), and the area ratio of the Fe matrix structure (20 to 40%) were all satisfactory.

In addition, as may be seen from FIG. 5A, the microstructure photograph of Example 2 had a dual-phase structure including both a Cu matrix structure and an Fe matrix structure. In particular, it may be seen that each microstructure exhibited roundish structure distribution.

Figure 6A:
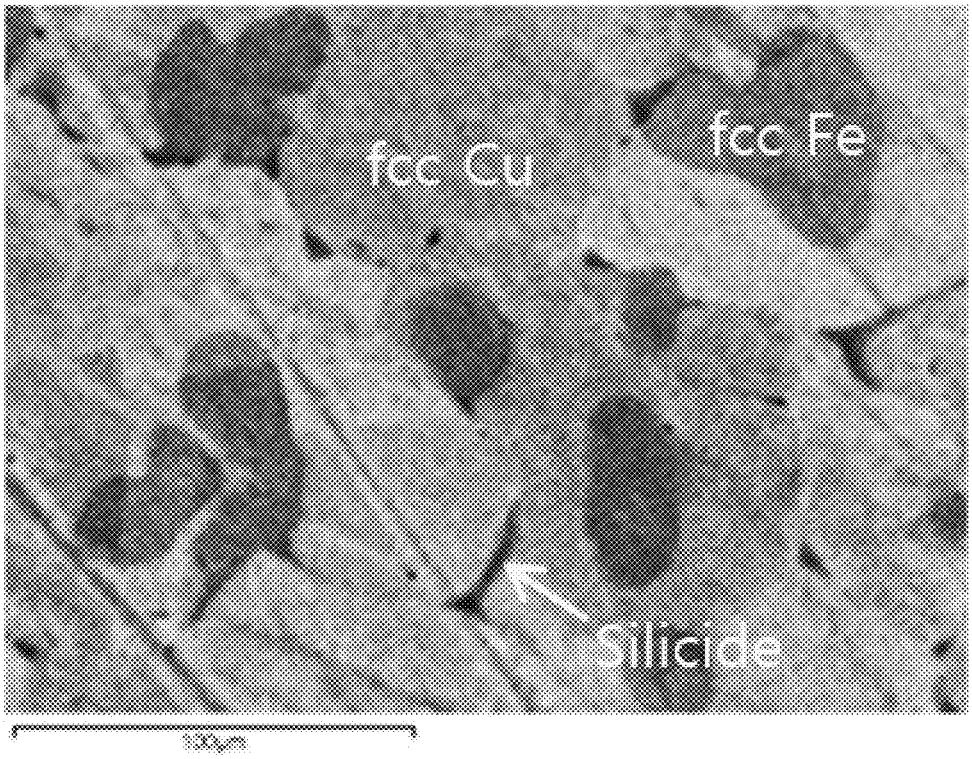
FIGS. 6A-6E are microstructure photographs of Examples 4 to 6 and Comparative Examples 2 and 5, respectively.
Figure 6B:
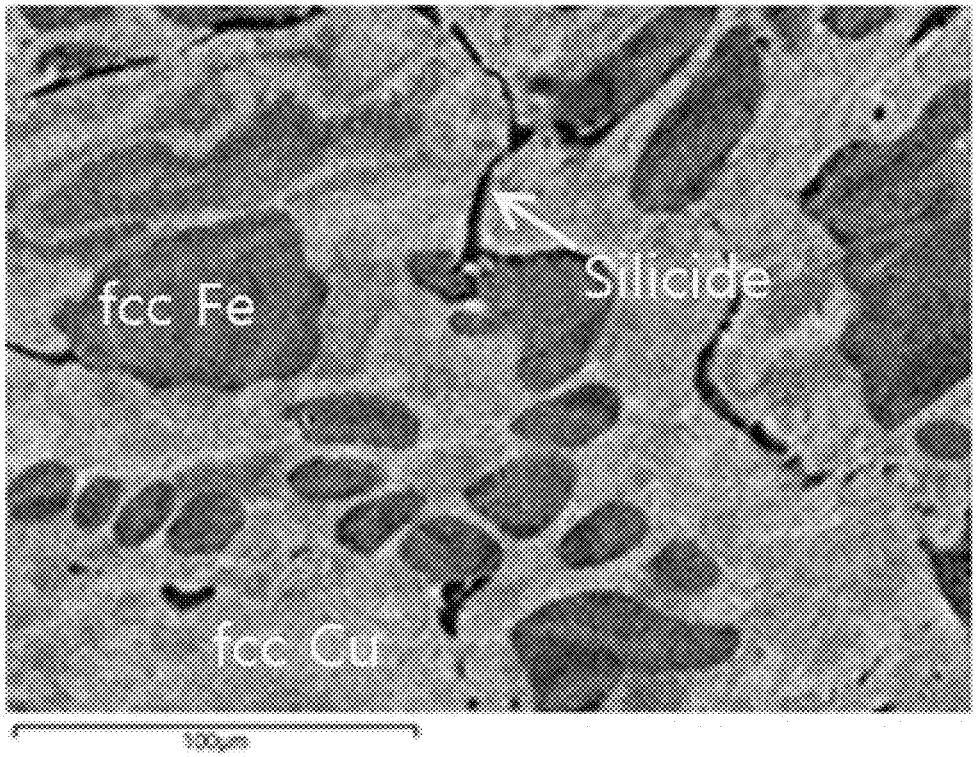
Figure 6C:
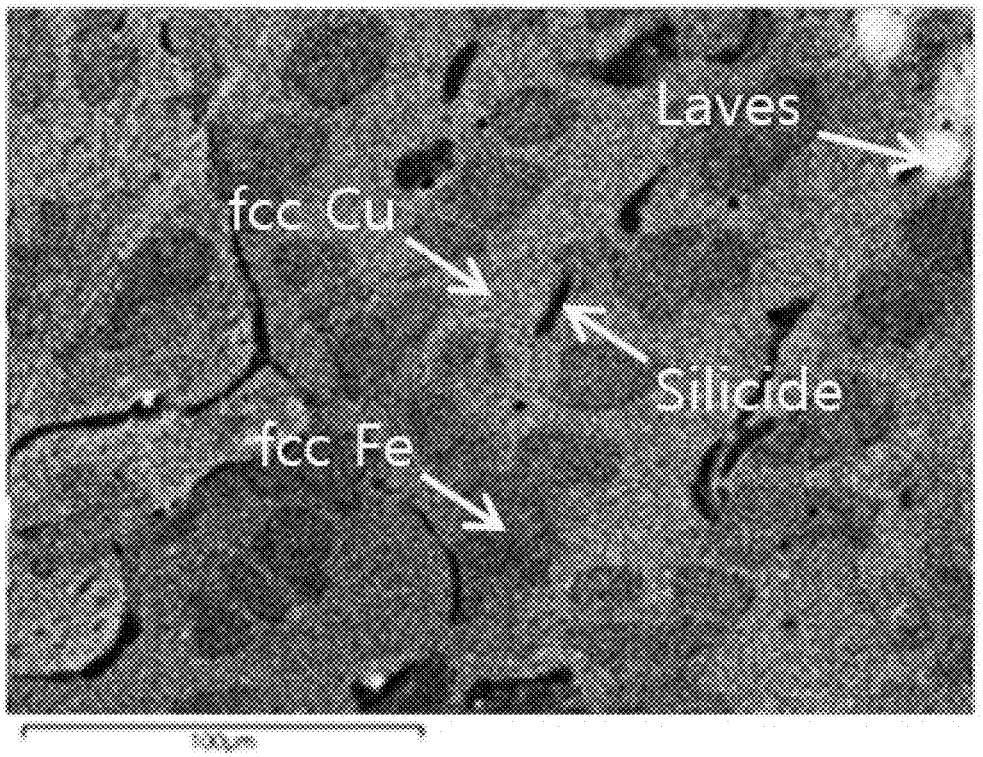
Figure 6D:
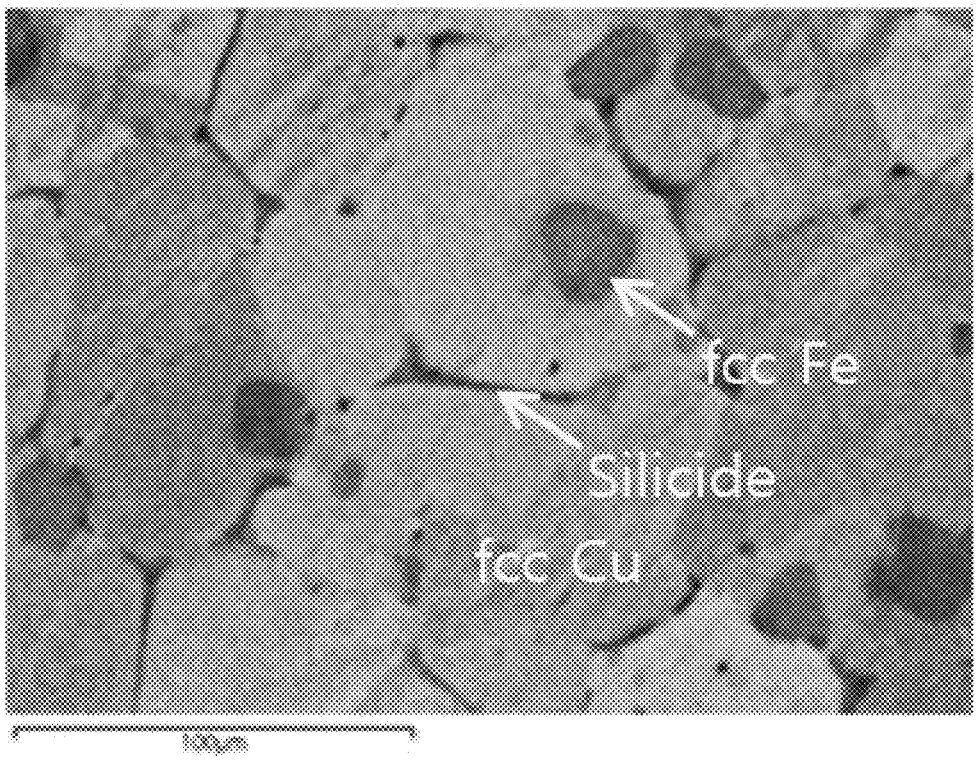
Figure 6E:
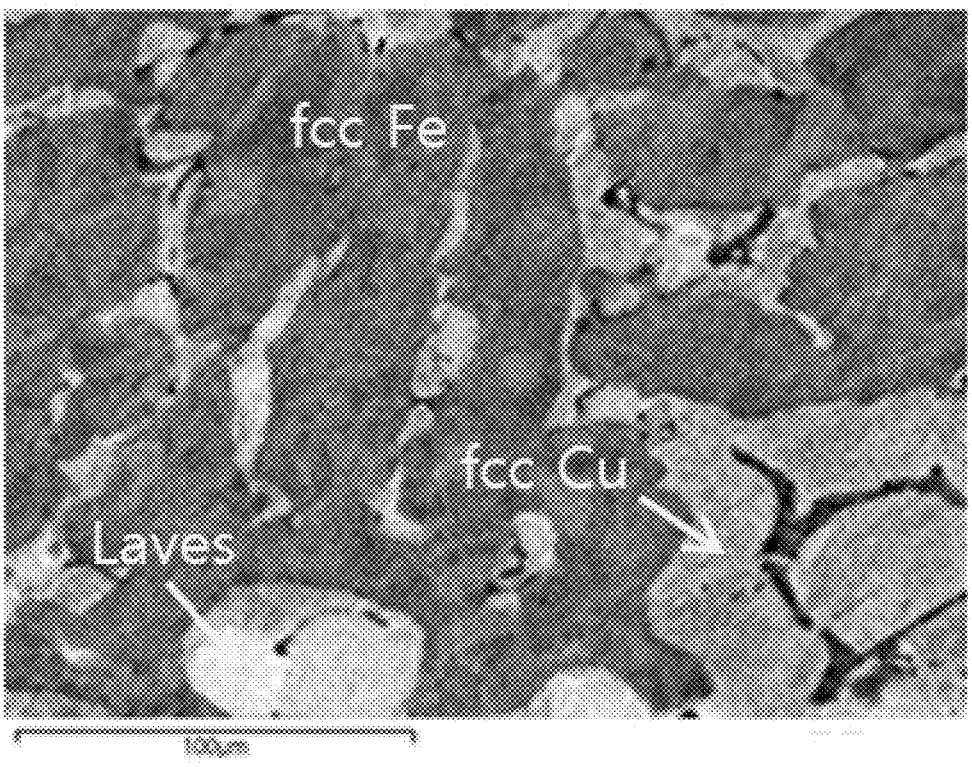

In addition, as may be seen from FIGS. 6A to 6C, each of the microstructure photographs of Examples 4 to 6 had a dual-phase structure including both a Cu matrix structure and a considerable amount of an Fe matrix structure, and particularly a silicide-based hard phase was formed. In particular, as may be seen from FIG. 6C, the microstructure photograph of Example 6 had a Laves phase.

Meanwhile, in the case of Comparative Examples 2 to 4, in each of which the content of Fe was less than the content suggested by the present disclosure, no cracks were generated, and the thickness of the heat affected zone was small. However, it may be seen that an Fe matrix structure was formed in a small amount, whereby the effect of improving wear resistance was significant. As may be seen from FIG. 6F, the microstructure photograph of Comparative Example 2 had a dual-phase structure including both a Cu matrix structure and an Fe matrix structure; however, the amount of the Fe matrix structure formed was relatively small.

Meanwhile, in the case of Comparative Examples 5 to 7, in each of which the content of Fe was greater than the content suggested by the present disclosure, an Fe matrix structure was excessively formed, whereby cracks were generated, and the thickness of the heat affected zone was large. At this time, the wear amount was not measurable. As may be seen from FIG. 6E, the microstructure photograph of Comparative Example 5 had a dual-phase structure including both a Cu matrix structure and an Fe matrix structure; however, the amount of the Fe matrix structure formed was relatively large.

Also, in the case of Comparative Examples 8 to 10, in each of which the content of Mo was greater than the content suggested by the present disclosure, no cracks were generated, and the thickness of the heat affected zone was small. However, it may be seen that a sigma phase was formed, whereby the wear amount was considerably large. Also, in the case of Comparative Examples 8 to 10, fitting also occurred.

In the case of Comparative Examples 11 to 13, in each of which the content of Mo was less than the content suggested by the present disclosure, the thickness of the heat affected zone was small and a dual phase including both a Cu matrix structure and an Fe matrix structure was formed. However, it may be seen that an acicular or reticular Fe matrix structure was formed, whereby deep cracks were generated, and the wear amount was considerably large.

Also, in the case of Comparative Example 14, in which Fe alone was added to a component system of Cu-17Ni-3Si, the thickness of the heat affected zone was small and a dual phase including both a Cu matrix structure and an Fe matrix structure was formed, in the same manner as in Comparative Examples 11 to 13. However, it may be seen that an acicular or reticular Fe matrix structure was formed, whereby deep cracks were generated, and the wear amount was considerably large.

In addition, as may be seen from FIG. 5B, the microstructure photograph of Comparative Example 14 had a dual-phase structure including both a Cu matrix structure and an Fe matrix structure. However, it may be seen that liquid immiscibility did not appropriately occur, whereby an acicular or reticular Fe matrix structure was formed.

Meanwhile, in the present disclosure, the content relationship between Fe and Mo was defined as expressed by Relation 1 below such that the area fraction of the Fe matrix structure is 20 to 40% of the total area.

$$15.55<1.04[Fe]-0.004[Mo]<36.38 \qquad \text{Relation 1}$$

where [Fe] and [Mo] mean the content (wt %) of Fe and Mo, respectively.

In order to determine whether Relation 1 above was appropriate, Fe and Mo were added to a component system of Cu-17Ni-3Si while the content of Fe and Mo was changed, as shown in FIG. 7, to form alloys. 1.04 [Fe]−0.004 [Mo] value of each alloy and the area fraction of a Fe matrix structure of each alloy are also shown in FIG. 7.

As may be seen from FIG. 7, No. 2 to No. 10 alloys, each of which satisfied the content of Fe and Mo suggested by the present disclosure, also satisfied both Relation 1 and the area fraction of the Fe matrix structure.

However, No. 1 and No. 11 to No. 16 alloys, each of which did not satisfy the content of Fe suggested by the present disclosure, satisfied neither Relation 1 nor the area fraction of the Fe matrix structure.

In addition, No. 17 alloy, in which the content of Mo exceeded the content of Mo suggested by the present disclosure, satisfied neither Relation 1 nor the area fraction of the Fe matrix structure.

Meanwhile, No. 18 alloy, in which the content of Mo was less than the content of Mo suggested by the present disclosure, satisfied Relation 1; however, the area fraction of the Fe matrix structure was not satisfied since the content of Mo was too small.

As is apparent from the above description, according to an embodiment of the present disclosure, a hard Fe matrix structure may be formed in a Cu matrix structure so as to have an area ratio of 20 to 40%, whereby it is possible to form a clad layer having high wear resistance.

Consequently, it is possible to form a thinner clad layer than in a method of separately manufacturing a valve seat and fastening the valve seat to a cylinder head. Therefore, it is possible to form straight intake and exhaust paths in an engine and thus to improve intake and exhaust efficiencies.

As a result, it is possible to improve in-cylinder tumbling and thus to improve fuel efficiency of the engine.

Although embodiments of the present disclosure have been described with reference to the accompanying drawings, the present disclosure is defined by the following claims, rather than the embodiments. Therefore, those having ordinary skill in the art will appreciate that the present disclosure may be variously changed and modified within the technical idea of the following claims.

What is claimed is:

1. A copper alloy for engine valve seats manufactured by laser cladding, wherein the copper alloy comprises 12 to 24 wt % of Ni, 2 to 4 wt % of Si, 4 to 12 wt % of Mo, 15 to 35 wt % of Fe (not including 15 wt % of Fe), and a remaining wt % of Cu and impurities, and wherein a matrix structure of the copper alloy has a dual phase comprising both a Cu matrix structure and an Fe matrix structure, wherein an area fraction of the Fe matrix structure of the copper alloy is 20 to 40 wt % of a total area, and wherein the copper alloy satisfies Relation 1 below:

$$15.55<1.04[Fe]-0.004[Mo]<36.38 \qquad \text{[Relation 1]},$$

where [Fe] and [Mo] mean the content (wt %) of Fe and Mo, respectively.

2. The copper alloy according to claim 1, wherein a Ni Si-based hard phase is formed in the matrix structure of the copper alloy, and at least one of a Mo-based Laves phase and a μ (mu) hard phase is further formed in the matrix structure of the copper alloy.

3. The copper alloy according to claim 1, wherein no sigma phase is formed in the copper alloy.

4. The copper alloy according to claim 1, wherein a wear amount of the copper alloy measured through a high-temperature frictional wear experiment carried out under conditions below is less than 20,000 $\mu m^2$:

(High-temperature frictional wear experimental conditions)

Pin material: Inconel,

Load: 50N,

Temperature: 200° C.,

Stroke: 7 mm,

Number of vibrations: 6 Hz,

Atmosphere: Air, and

Time: 10 min.

5. The copper alloy according to claim 1, wherein a thickness of a heat affected zone of the copper alloy is 1 mm or less after laser cladding.

* * * * *